US005746425A

United States Patent [19]

Flannery, Jr.

[11] Patent Number: 5,746,425

[45] Date of Patent: May 5, 1998

[54] GRIPPER-ACCUMULATOR

[75] Inventor: James W. Flannery, Jr., Stamford, Conn.

[73] Assignee: Time Inc., New York, N.Y.

[21] Appl. No.: 742,772

[22] Filed: Nov. 1, 1996

[51] Int. Cl.[6] ..... B65H 39/00

[52] U.S. Cl. ..... 270/52.14; 270/60

[58] Field of Search ..... 270/52.01, 52.14, 270/58.01, 60

[56] References Cited

U.S. PATENT DOCUMENTS

| | | | |
|---|---|---|---|
| 4,720,091 | 1/1988 | Kobler | 270/52.01 |
| 4,767,112 | 8/1988 | Kobler | 270/52.14 |
| 4,981,291 | 1/1991 | Honegger et al. | 270/55 |
| 5,052,666 | 10/1991 | Hansch | 270/55 |
| 5,556,087 | 9/1996 | Gosslinghoff | 270/58.18 |

*Primary Examiner*—Hoang Nguyen

*Attorney, Agent, or Firm*—Fish & Neave; Jeffrey H. Ingerman

[57] ABSTRACT

A gripper-accumulator and system for gripping, accumulating and transporting two or more pieces along an production line. The gripper-accumulator is particularly useful in accomplishing higher production speeds in the production of periodicals and magazines. The gripper-accumulator has two or more gripper-fingers and a fixed support extending radially out of a hub. The gripper-fingers are capable of rotating around the hub from a initially open to a eventually closed position adjacent to the fixed support. At the closed position a piece is gripped between the fixed support and the gripper-finger, or between two adjacently located gripper-fingers. Thus, a single gripper-accumulator is provided that is capable of holding several pieces thereby speeding production.

29 Claims, 6 Drawing Sheets

GRIPPER-ACCUMULATOR

BACKGROUND OF THE INVENTION

The present invention relates to grippers for gripping and accumulating pieces of a book. In particular, this invention relates to gripper-accumulators that can grip and accumulate two or more pieces of a book.

A magazine or a periodical typically comprises a stack of individual sheets or folios (collectively "signatures") bound together. These stacks of signatures pass through various stations along a production line before they are bound into a complete periodical or a magazine (collectively "book") ready to be marketed.

The production line typically comprises several stack feeders, each holding a stack of signatures corresponding to a different piece of a book. Traditionally, each respective stack feeder would serially deposit one of its respective signatures into each of a plurality of pockets. A gripping mechanism on the production line would transfer a single respective signature to the respective pocket. Eventually, each pocket would accumulate a complete book which would then be bound, freeing that particular pocket to begin accumulating a new book. The number of books that could be assembled by a production line was thus limited by the number of pockets on the line. Machines on such lines were thus very large and expensive.

It would be desirable to be able to provide a gripper-accumulator that can grip and accumulate two or more signatures.

It would also be desirable to be able to reduce or eliminate the number of pockets required on a book production line.

SUMMARY OF THE INVENTION

It is an object of this invention to provide a gripper-accumulator for gripping and accumulating two or more signatures.

It is also an object of this invention to be able to reduce or eliminate the number of pockets required on a book production line.

In accordance with the invention, there is provided a gripper-accumulator for gripping and accumulating two or more pieces. The gripper-accumulator includes a hub extending along an axis. Extending radially outward from the hub is a fixed support. Also provided are a plurality of gripper-fingers that are rotatably affixed to the hub. The gripper-fingers are angularly spaced about the axis and each is capable of moving between a respective releasably secured open position remote from the fixed support and a respective closed position adjacent to the fixed support. A respective of force-applying member biases each respective one of the gripper-fingers toward the fixed support, such that the first one of the pieces is held between the fixed support and the first gripper-finger, while the rest of the pieces are each held between two angularly adjacent gripper-fingers.

A system incorporating such a gripper-accumulator is also provided.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which.

DETAILED DESCRIPTION OF THE INVENTION

Figure 1:
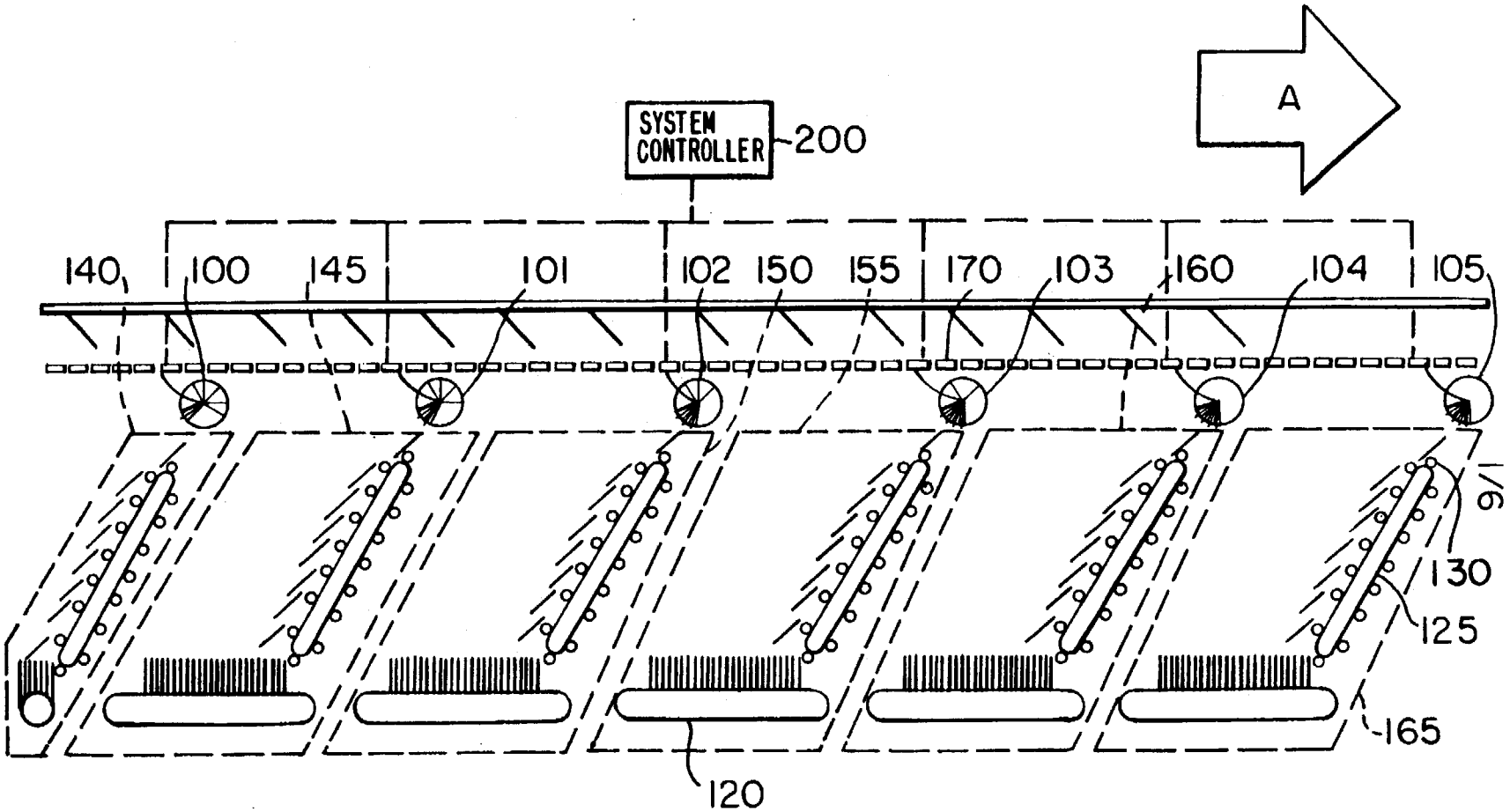
FIG. 1 is a schematic elevational view of a preferred embodiment of book assembly system incorporating a gripper-accumulator according to the present invention.

The present invention provides a gripper-accumulator that can grip and accumulate two or more pieces, as well as a book assembly and manufacturing system that incorporates such a gripper-accumulator. The actual number of pieces accumulated by the gripper-accumulator is preferably equal to the number of pieces in a book. A piece, as defined herein, is a single sheet of paper or a signature.

A production line may have several gripper-accumulators, each of which grips and accumulates two or more different pieces from different piece-presenters. Previously known systems used pockets to accumulate pieces corresponding to a periodical or magazine, as discussed above. This was a relatively slow process because at each piece-presenter station (e.g., the stack feeder discussed above), one gripper moved one piece at a time from a respective piece-presenter to a respective pocket for accumulation, with the gripper moving twice—i.e., from the piece-presenter to the pocket and back again. Eventually, each pocket would accumulate a complete book, freeing that particular pocket to begin accumulating a new book. The number of books that could be assembled by a production line was thus limited by the number of pockets on the line.

The present invention relies instead on the gripper-accumulator to grip a piece and hold onto it while moving to the next piece-presenter, thereby accumulating all of the pieces of a book without need for pockets, and without using the time it takes for the griper to move between each piece-presenter and the pocket. This system preferably has several gripper-accumulators moving along a production line on a conveyor. As each of these gripper-accumulators pass piece-presenters presenting different pieces, a single gripper-finger is released to grip the piece presented. Successive gripper-fingers are individually released to grip and accumulate different pieces offered by successive piece-presenters as the conveyor continues to move the gripper-accumulator from one piece-presenter to the next. Thus, after a gripper-accumulator has passed each of the piece-presenters in the system, it has accumulated all pieces necessary, in a predetermined order, for a book.

The gripper-accumulator of the invention preferably has two or more gripper-fingers extending radially outward from a hub. These gripper-fingers preferably are capable of rotation around the hub, but preferably are initially held in an open position by a movable pawl, or a similar device, preferably capable of selectively releasing one gripper-finger at a time.

A fixed support preferably extends radially out from the hub. The fixed support could be a relatively flat plate made of plastic or metal, a wire loop, or any other similar structure which is capable of acting as a backplate against which the gripper-fingers can rest when they are released by the movable pawl and, under the force of a force-applying member, rotate around the hub to a substantially closed position adjacent to the fixed support. It is in this closed position that a piece is securely gripped between either the gripper-finger and the fixed support, or the gripper-finger and an arcuately adjacent, and previously released, gripper-finger. Each gripper-finger, like the fixed support, could be a relatively flat plate made of plastic or metal, a wire loop, or any other similar structure capable of securely holding a piece.

The gripper-fingers preferably are individually secured for rotation about the axis of the hub by cylindrical extensions that extend around the hub. Preferably, there are two such cylindrical extensions for each gripper-finger. The cylindrical extensions preferably are similar to those extending from the hinge plate of a standard door hinge.

When the gripper-accumulator reaches the first piece-presenter, and a first piece that needs to be gripped is presented to the gripper-accumulator by the piece-presenter, a gripper-finger is released by the pawl resulting in a gripper-finger rotating around the hub, from its initially open position to its closed position adjacent to the fixed support. The first piece is thus gripped between a first gripper-finger and a fixed support, under the bias action of a force-applying member. The piece-presenter is preferably a feeder that removes a piece from a stack of pieces and presents it so that it extends into the path of the gripper-accumulator, which can grip it without interference by other pieces in the stack.

After all required pieces have been accumulated by a respective one of the gripper-accumulators, that gripper-accumulator releases those pieces to a respective transfer device moving on a respective conveyor along the production line. The transfer device preferably is a gripper and preferably is capable of receiving all pieces accumulated by a gripper-accumulator between two fingers, without separating each piece from the next by intermediate fingers. The transfer device maintains the order of the pieces as it receives them from the gripper-accumulator, but may change their orientation for binding, if necessary.

The transfer device preferably releases the pieces it receives from the gripper-accumulator to a stacking device. The stacking device preferably includes a tray that receives the transferred pieces. The tray preferably has an edge against which the edge of the pieces representing the edge of the book to be bound become aligned. The stacking device is disposed along yet another conveyor moving at a speed that exceeds the speed at which the conveyor carrying the transfer device is moving. This difference in speed causes each stack of pieces to lag behind the stacking device as it lands on the stacking device, thereby preventing pieces from hitting the edge of the tray and folding as they are released onto the stacking device. The pieces are preferably stacked in the tray for presenting to a binding device that binds them into a periodical or magazine.

While a gripper-finger on a gripper-accumulator can have any shape suitable for its defined purpose, gripper-fingers of the preferred embodiment of a gripper-accumulator according to this invention are preferably substantially flat plates. This allows for an even support and grip to the pieces as they are gripped and accumulated and, eventually moved along the production line. Specifically, use of substantially flat plates for gripper-fingers increases the surface area of the gripper-finger in contact with the pieces being gripped and accumulated thereby increasing the amount of holding force for a given pressure, as compared to a wire loop for example. Similarly, the transportation device could be conventional link chains, conveyors, or other similar devices used in production lines.

When a piece is presented to the gripper-accumulator by a piece-presenter, the piece itself could trip a lever on the gripper-accumulator that moves the pawl to release the gripper-fingers. However, such an embodiment would depend on the pieces having sufficient stiffness to actuate the trip lever, which may not always be the case. Therefore, the pawl preferably is released by a trip lever that is actuated by a cam positioned on the production line adjacent to the piece-presenter so that the gripper-finger is released just as the piece is in the position to be gripped. By mounting the cam so that it can be moved out of the path of the trip lever on the gripper-accumulator, one can provide for selective binding of magazines.

In a selective binding system, a system controller—e.g., a suitably programmed general purpose computer—would keep track of which subscriber's magazine is being accumulated by each gripper-accumulator. According to various demographic criteria, particular subscribers may not receive particular pieces in their magazines. As a gripper-accumulator carrying such a magazine approaches the piece-presenter of a piece to be omitted, the system controller could instruct a suitable servo mechanism to retract the cam out of the path of the trip lever on the gripper-accumulator, so that as the gripper-accumulator passes, it does not grip that particular piece. The system would return the cam to its normal position for the next gripper-accumulator. By providing such movable cams at all piece-presenters any piece could be selectively omitted from any individual magazine.

FIG. 1 shows a schematic elevational view of a preferred embodiment of a system according to this invention, using gripper-accumulators 100–105 to grip and accumulate pieces 120 from piece-presenters 140, 145, 150, 155, 160, and 165. All piece-presenters preferably have stack feeder 120, conveyor 125, and presentation elements 130. As gripper-accumulator 100 moves along conveyor 170 in the direction shown by arrow A, it receives and accumulates pieces from piece-presenters 140, 145, 150, 155, 160, and 165. As shown in FIG. 1, gripper-accumulator 100 has only received a piece from piece-presenter 140, and is thus shown carrying one piece. Subsequent gripper-accumulator 101 has received a piece from piece-presenters 140 and 145, and is thus shown carrying two pieces. Similarly, gripper-accumulator 102 has received a piece from piece-presenters 140, 145, and 150, and is thus shown carrying three pieces. Gripper-accumulators 103, 104, and 105 have received a piece from each one of the piece-presenters they have passed, and are thus shown carrying four, five, and six pieces respectively.

Figure 2:
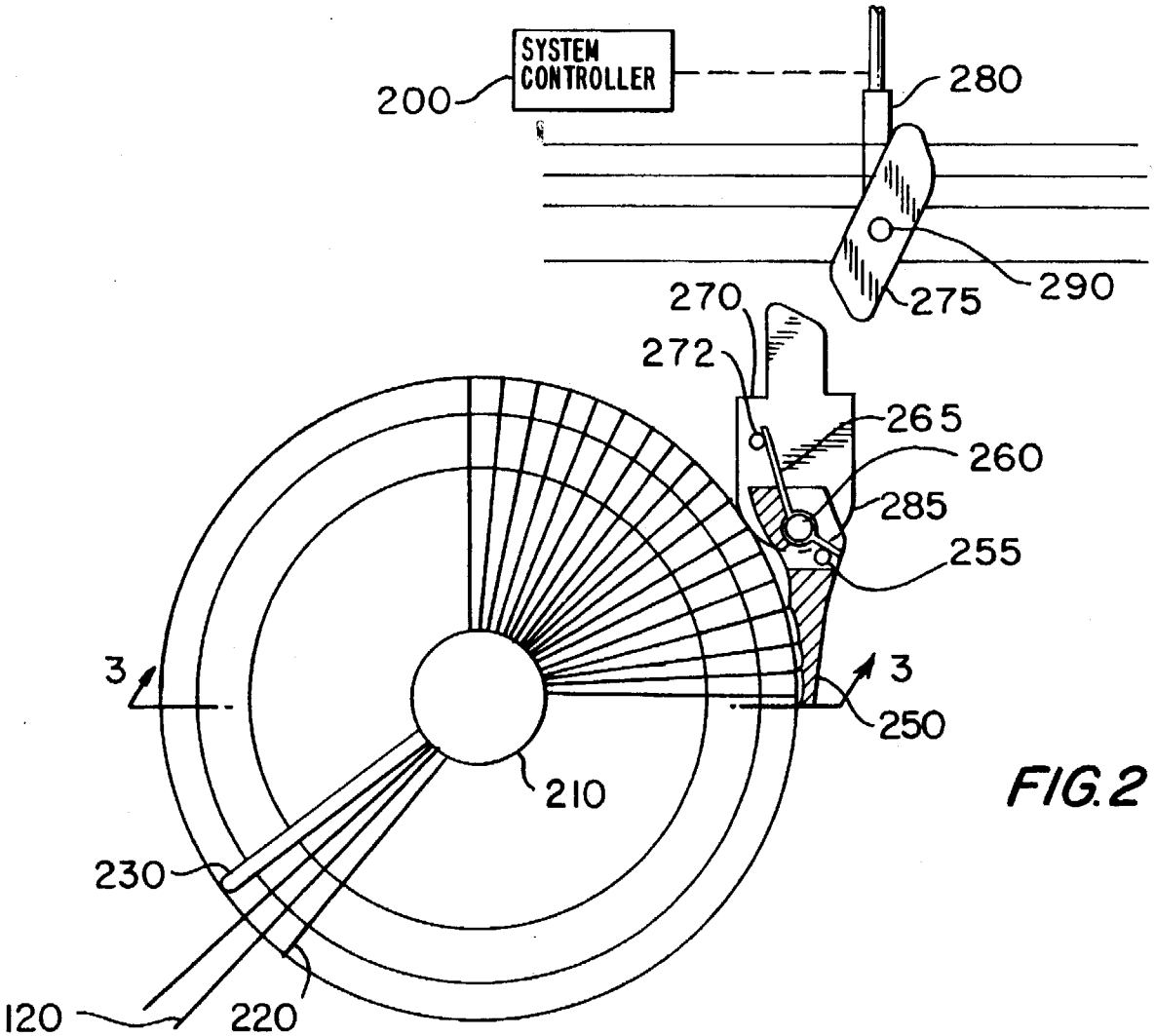
FIG. 2 is a simplified elevational view of the gripper-accumulator of FIG. 1.

FIG. 2 shows a simplified elevational view of a preferred embodiment of a gripper-accumulator 100 of FIG. 1. Gripper-accumulator 100, as shown in FIG. 1, has a hub 210, which has several gripper-fingers 220 radially extending from it. A fixed support 230 is also shown to be radially extending out of hub 210. Also shown is the first one of several gripper-fingers 220 in a closed position holding a first one of several pieces 120 between itself and fixed support 230.

Gripper-fingers 220 are held in an initially open position by pawl 250. Preferably, fork member 270 is connected to pawl 250 by means of pin 260. Pawl 250 can swivel on pin 260 of fork member 270. Pre-tensioned spring 265 mounted on pin 260 and between pin 272 and pin 255 biases pawl 250 toward gripper-fingers 220. As gripper-accumulator 100 passes cam 275, cam 275 pushes fork member 270 downward causing pawl 250 to swivel on pin 260, in a counterclockwise direction, just enough for it to release a single gripper-finger 220. To prevent gripper-accumulator 100 from gripping a piece being offered by a piece-presenter (e.g., in a selective binding system as discussed above), system controller 200 retracts cam 275 out of the path of fork member 270 by retracting servo mechanism 280, so that as gripper-accumulator 100 passes, it does not grip that particular piece.

Figure 3:
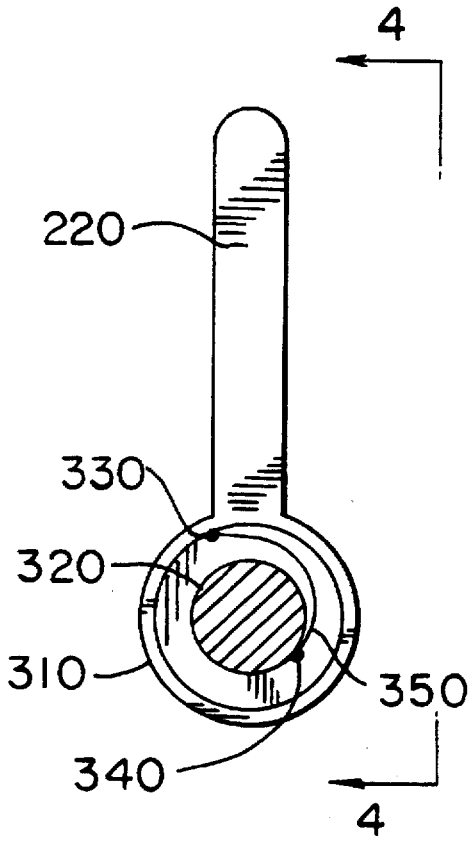
FIG. 3 is a partial sectional view taken from line 3—3 of FIG. 2.
Figure 4:
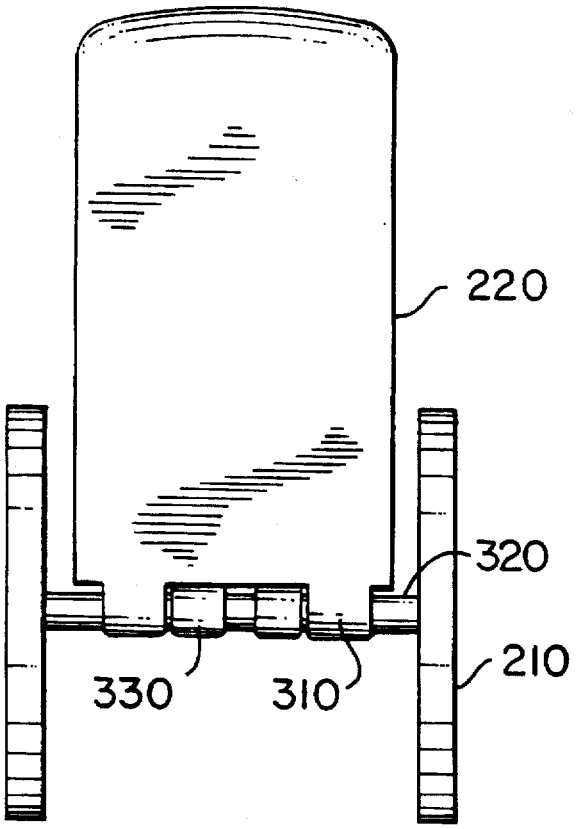
FIG. 4 is a simplified elevational view taken from line 4—4 of FIG. 3.

The preferred construction of gripper-accumulator 100 is shown in FIGS. 3 and 4. Gripper-finger 220 is rotatably affixed to shaft 320 by cylindrical extensions 310. Gripper-finger 220 of FIG. 4 has two cylindrical extensions 310. Cylindrical extensions 330 belong to an adjacently located gripper-finger. Although only two sets of cylindrical extensions are shown in FIG. 4 for clarity, it would be understood that each gripper-finger has a respective set of cylindrical extensions rotatably attaching it to shaft 320, which may be longer than shown in FIG. 4. Moreover, although each gripper-finger as shown has two cylindrical extensions, it is possible to provide only one cylindrical extension or, alternatively, more than two cylindrical extensions.

Shown in the sectional view is spring 350 attached to shaft 320 of hub 210, at one end, by pin 340. The other end of spring 350 is attached to gripper-finger 220 by pin 330. Spring 350 biases gripper-finger 220 in the direction of fixed support 230 (not shown in FIG. 3). Although, for simplicity, only spring 350 is shown in FIG. 3, it would be understood that each respective gripper-finger 220 has a respective spring biasing it toward fixed support 230. Spring 350 is preferably a flat spring that is wrapped around shaft 320, or it can be a coil spring that coils along shaft 320. FIG. 3 also shows gripper-finger 220 rotatably affixed to axis 320 by cylindrical extension 310. Spring 350 need provide only a few ounces of pressure to hold a single piece of a magazine or book.

Figure 5:
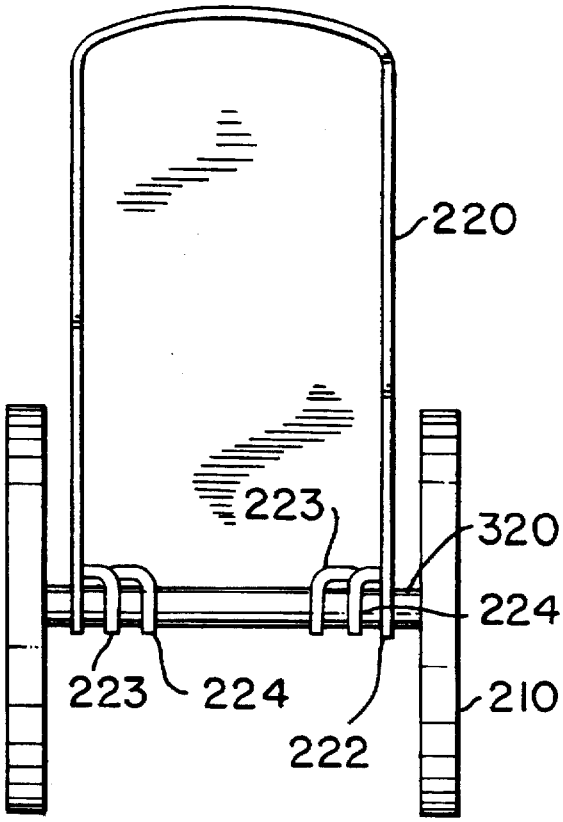
FIG. 5 is a view similar to FIG. 4 showing another embodiment of a gripper-finger.

An alternate embodiment of gripper-finger 220 is shown in FIG. 5. Gripper-finger 220, as shown in FIG. 5, is a wire loop that has both of its ends rotatably wrapped at 222 around shaft 320. Also shown are additional sets of loop ends 223, 224, which represent the ends of additional wire loops that are not otherwise visible because they are directly behind loop 220. Although only three sets of loop ends are shown in FIG. 5 for clarity, it would be understood that each gripper-finger has a respective set of loop ends rotatably wrapped around shaft 320, which may be longer than shown in FIG. 5.

Figure 6:
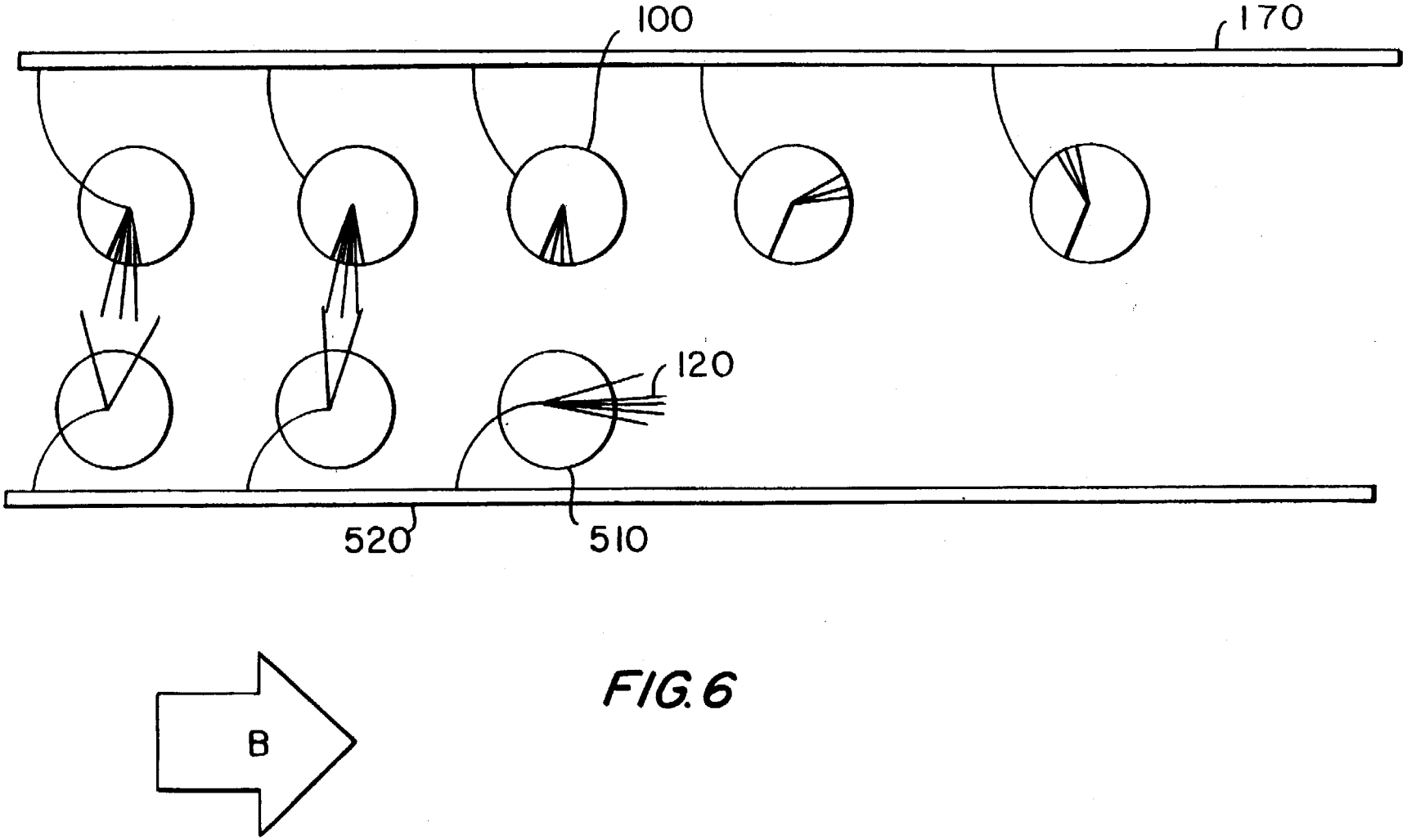
FIG. 6 is a schematic elevational view of gripper-accumulators of FIGS. 2–4 delivering accumulated pieces to a preferred embodiment of a transfer device.
Figure 7:
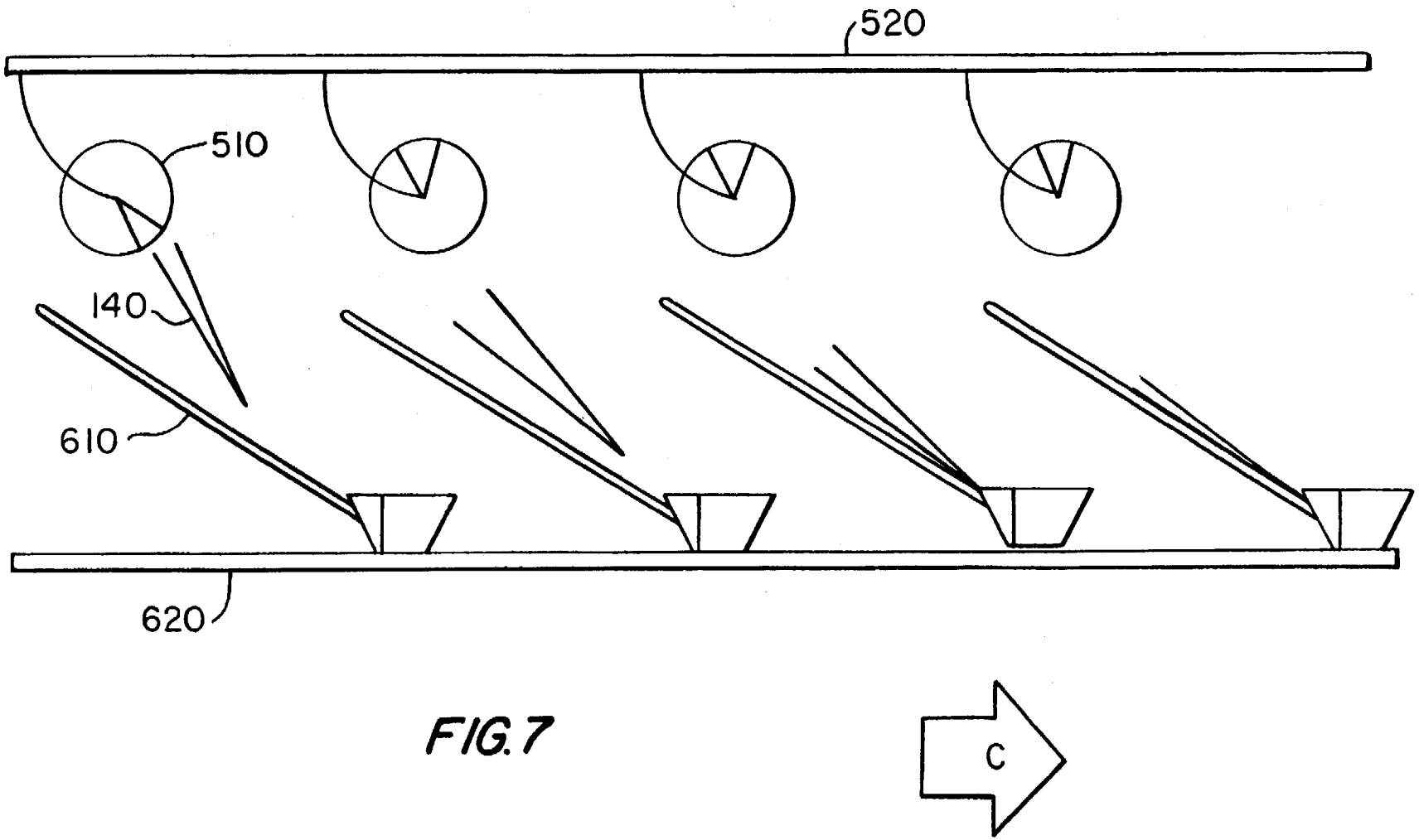
FIG. 7 is a schematic elevational view of the transfer device of FIG. 5 transferring pieces received from a gripper-accumulator to a preferred embodiment of a stacking device.

FIG. 6 is a schematic elevational view of gripper-accumulators 100 delivering accumulated pieces 120 to transfer devices 510. Each gripper-accumulator 100, after having received all pieces corresponding to a periodical or magazine, preferably releases the accumulated pieces to a respective transfer device 510 moving on conveyor 520 in the direction shown by arrow B. Transfer device 510 receives the pieces accumulated by gripper-accumulator 100 while maintaining the order in which pieces 140 were received by gripper-accumulator 100. Each transfer device 510 preferably holds the full set of pieces between two fingers, rather than separating each piece from its neighbor by a finger. The main purpose of transfer-device 510 is to present the completed set of pieces to stacking device 610 for eventual binding. Transfer device 610 could optionally be eliminated if the free ends of the pieces in gripper-accumulator 100 represent the edge to be bound.

Transfer device 510 preferably transfers the pieces received from gripper-accumulator 100 to stacking device 610, with the edge to be bound preferably advancing onto stacking device 610 first. Stacking device 610 moves on conveyor 620 in the direction shown by arrow C. The speed of conveyor 620 preferably is greater than the speed of conveyor 520, on which transfer device 510 is moving. The difference in speed causes each set of pieces to lag behind stacking device 610 as it drops onto stacking device 610, prevents the leading edge of the stack of pieces from hitting the edge of stacking device 610 and thereby reducing or eliminating the possibility of folding resulting from the stack hitting the edge too hard. Stacking device 610 aligns the edge of the pieces for presentation to a binding station on the production line (not shown).

Thus it is seen that a gripper-accumulator that can grip and accumulate two or more pieces has been provided. One skilled in the art will appreciate that the present invention can be practiced by other than the described embodiments, which are presented for purposes of illustration and not of limitation, and the present invention is limited only by the claims which follow.

What is claimed is:

1. A gripper-accumulator for releasably gripping and accumulating a plurality of pieces, said gripper-accumulator comprising:

a hub extending substantially along an axis;

a fixed support extending radially outward from said hub;

a plurality of gripper-fingers rotatably affixed to said hub and angularly spaced about said axis, each being movable between a respective releasably secured open position remote from said fixed support and a respective closed position adjacent to said fixed support; and a plurality of force-applying members, each of said force-applying members biasing a respective one of said gripper-fingers toward said respective closed position; whereby:

one of said plurality of pieces is held between said fixed support and a first one of said plurality of gripper-fingers, and each additional one of said plurality of pieces is held between two angularly adjacent ones of said gripper-fingers.

2. The gripper-accumulator of claim 1 further comprising a movable pawl for releasably securing each said gripper-finger in said respective open position.

3. The gripper-accumulator of claim 1 further comprising a tripping device for releasing one of said gripper-fingers.

4. The gripper-accumulator of claim 3 wherein said tripping device is a lever.

5. The gripper-accumulator of claim 1 wherein each said force-applying member comprises a spring.

6. The gripper-accumulator of claim 1 wherein each of said gripper-fingers has at least one cylindrical extension rotatably affixing a respective one of said gripper-finger to said hub.

7. The gripper-accumulator of claim 6 wherein each of said gripper-fingers has two of said cylindrical extensions.

8. The gripper-accumulator of claim 1 wherein said gripper-fingers are open wire loops.

9. The gripper-accumulator of claim 1 wherein said gripper-fingers are substantially flat plates.

10. The gripper-accumulator of claim 1 wherein said gripper-fingers are substantially identical.

11. A system for collating and transporting a plurality of pieces along a production line, said system comprising:

a plurality of gripper-accumulators for releasably gripping and accumulating said plurality of pieces;

a first transportation device for transporting said plurality of gripper-accumulators along said production line;

a plurality of piece-presenters for presenting said pieces to said gripper-fingers as said gripper-accumulators pass by; wherein:

said gripper-accumulator comprises:

a hub extending substantially along an axis;

a fixed support extending radially outward from said hub;

a plurality of gripper-fingers rotatably affixed to said hub and angularly spaced about said axis, each being movable between a respective releasably secured open position remote from said fixed support and a respective closed position adjacent to said fixed support; and a plurality of force-applying members, each of said force-applying members biasing a respective one of said gripper-fingers toward said respective closed position; whereby:

one of said plurality of pieces is held between said fixed support and a first one of said plurality of gripper-fingers, and each additional one of said plurality of pieces is held between two angularly adjacent ones of said gripper-fingers.

12. The system of claim 11 wherein each of said piece-presenters are grippers disposed along a conveyor.

13. The system of claim 11 further comprising a plurality of transfer devices, each of said transfer devices receiving said plurality of pieces from at least one of said plurality of gripper-accumulators, each of said transfer devices traveling on a second transportation device at a first speed.

14. The system of claim 13 wherein each of said transfer devices are grippers disposed along a conveyor.

15. The system of claim 13 wherein said second transportation device is substantially parallel to said first transportation device.

16. The system of claim 11 further comprising a stacking device for receiving said plurality of pieces from at least one of said transfer devices, said stacking device traveling on a third transportation device at a second speed.

17. The system of claim 16 wherein said stacking device is a tray.

18. The system of claim 16 wherein said second speed is greater than said first speed.

19. The system of claim 15 wherein said stacking device aligns said plurality of pieces.

20. The system of claim 11 further comprising a movable pawl for releasably securing each said gripper-finger in said respective open position.

21. The system of claim 11 further comprising a tripping device for releasing one of said gripper-fingers.

22. The system of claim 21 wherein said tripping device comprises a cam.

23. The system of claim 22 wherein:

said cam is movable between a position in which it actuates said tripping device and a position in which it does not actuate said tripping device; said system further comprising:

a servo mechanism for moving said cam between said positions; and a controller for selectively activating said servo mechanism.

24. The system of claim 11 wherein each said force-applying member comprises a spring.

25. The system of claim 11 wherein each of said gripper-fingers has at least one cylindrical extension rotatably affixing a respective one of said gripper-finger to said hub.

26. The system of claim 25 wherein each of said gripper-fingers has two of said cylindrical extensions.

27. The system of claim 11 wherein said gripper-fingers are open wire loops.

28. The system of claim 11 wherein said gripper-fingers are substantially flat plates.

29. The system of claim 11 wherein said gripper-fingers are substantially identical to one another.

* * * * *